United States Patent [19]

Barr et al.

[11] 4,414,163

[45] Nov. 8, 1983

[54] FUEL FEED AND CHARGE FORMING APPARATUS

[75] Inventors: Rodney E. Barr, Cary, N.C.; Daniel L. Donovan, Decatur, Ill.

[73] Assignee: Borg-Warner Corporation, Chicago, Ill.

[21] Appl. No.: 378,584

[22] Filed: May 17, 1982

[51] Int. Cl.[3] ..... F02M 17/04

[52] U.S. Cl. ..... 261/69 A; 261/DIG. 68; 251/359

[58] Field of Search ..... 261/DIG. 68, 69 A, 35; 251/359

[56] References Cited

U.S. PATENT DOCUMENTS

| | | | |
|---|---|---|---|
| 1,450,883 | 4/1923 | Bennett . | |
| 1,457,043 | 5/1923 | Schramm . | |
| 1,715,440 | 6/1929 | Wagner . | |
| 2,002,483 | 5/1935 | Kimball . | |
| 2,841,372 | 7/1958 | Phillips | 261/DIG. 68 |
| 2,844,352 | 7/1958 | Dahl | 251/359 |
| 3,056,575 | 10/1962 | Mooney . | |
| 3,059,898 | 10/1962 | Carlson et al. . | |
| 3,127,905 | 4/1964 | Vogeli . | |
| 3,269,713 | 8/1966 | Beck | 261/DIG. 68 |
| 3,275,306 | 9/1966 | Phillips | 261/DIG. 68 |
| 3,417,778 | 12/1968 | Ratelband . | |
| 3,441,010 | 4/1969 | Barr et al. . | |
| 3,458,170 | 7/1969 | Vogeli | 251/359 |
| 3,746,320 | 7/1973 | Van Camp et al. | 261/35 |
| 3,791,632 | 2/1974 | Donovan | 261/35 |
| 3,843,755 | 10/1974 | Tuckey | 261/69 |
| 3,933,949 | 1/1976 | Woody | 261/35 |
| 4,046,844 | 9/1977 | Rickert | 261/34 |
| 4,193,948 | 3/1980 | Charmley et al. | 261/DIG. 68 |
| 4,287,916 | 9/1981 | Sugimura et al. | 251/359 |

*Primary Examiner*—Tim R. Miles

*Attorney, Agent, or Firm*—Florian S. Gregorczyk

[57] ABSTRACT

The disclosure embraces a fuel feed and charge forming apparatus wherein the apparatus is of comparatively small size particularly for use with chain saws and other motor driven tools to effect the reduction in weight. The charge forming apparatus embodies a body construction providing external support members to resist creep and bolt-torque deformation, as well as providing a heat sink-heat transfer means. A valve seat construction for shape retention is also provided to inhibit fuel metering distortions caused by deformation of valve seats by carburetor body creep.

19 Claims, 17 Drawing Figures

Fig. 5.
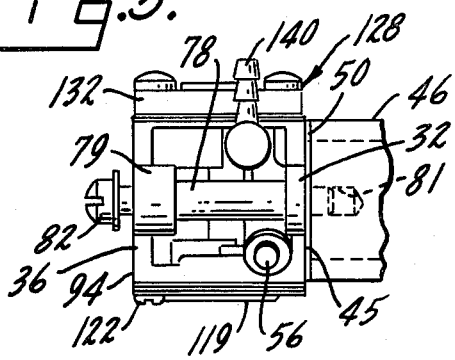
Fig. 6.
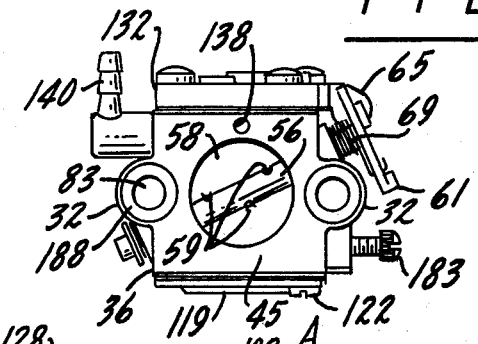
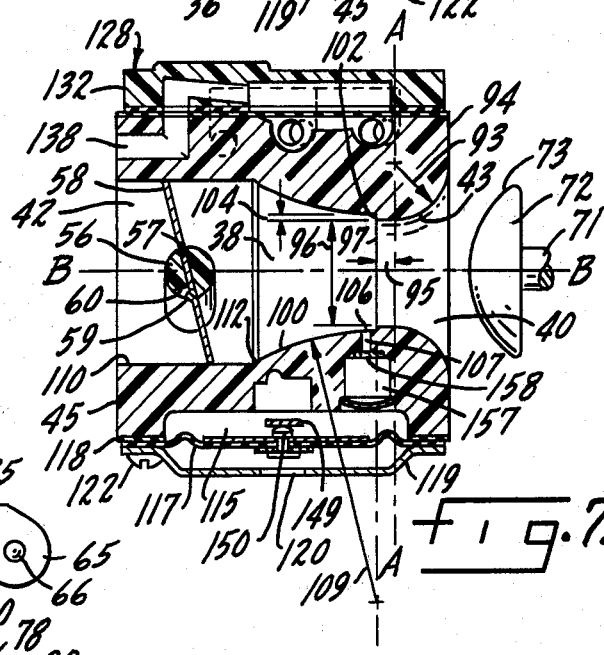
Fig. 7.
Fig. 8.
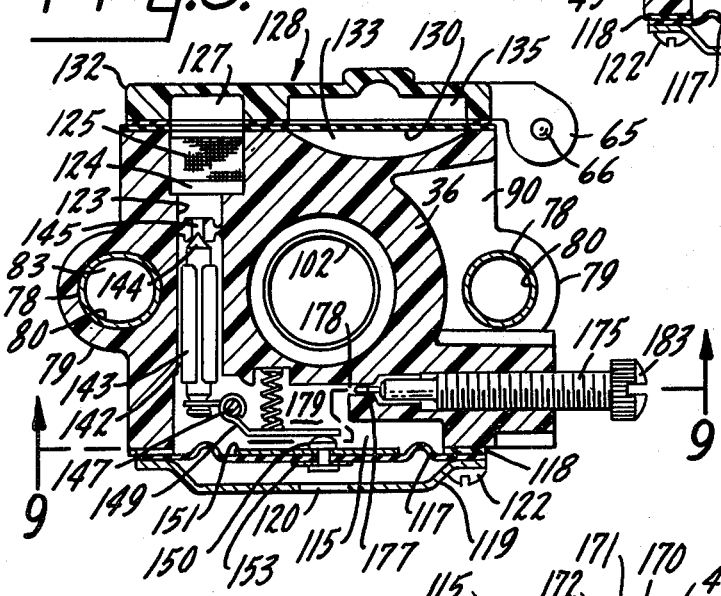
Fig. 9.
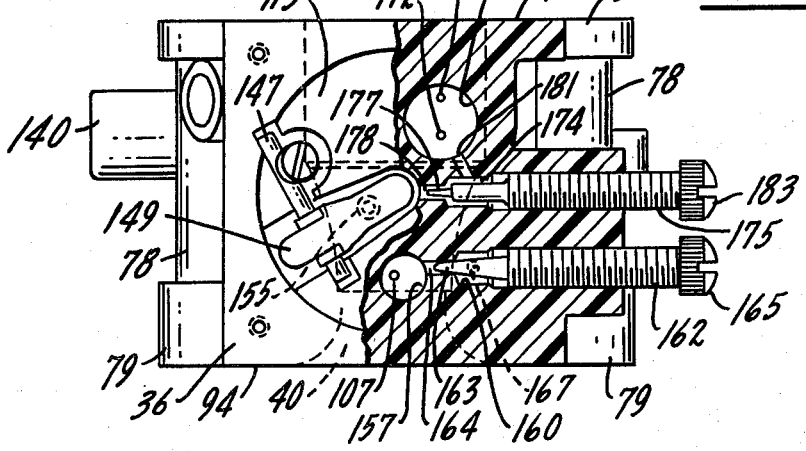

FUEL FEED AND CHARGE FORMING APPARATUS

BACKGROUND OF THE INVENTION

The invention relates to a fuel feed and charge forming apparatus for supplying a fuel/air mixture to internal combustion engines especially of the two-cycle type but which is applicable to other engine types. Such engines frequently drive chain saws, lawnmowers, outboard marine engines and similar loads. The fuel feed and charge forming apparatus involves a diaphragm type carburetor and diaphragm fuel pump, which are combined in a unitary construction of a generally cubic shape.

DESCRIPTION OF THE PRIOR ART

Carburetors of the diaphragm type are utilized on chain saws. The carburetor body construction in that application has been sized to provide a mixing passage of cross sectional area to accomodate air and fuel mixtures in volumes adequate to operate engines of low horsepower of the two-cycle type. Carburetor and fuel pump combinations have been devised to reduce the weight of the carburetor, particularly for use on chain saws, because it is desirable insofar as possible to reduce the weight of a portable chain saw. An example of this type of carburetor is disclosed and claimed in Phillips' U.S. Pat. No. 3,275,306. A further factor in the construction of a carburetor and fuel pump combination particularly for use with a chain saw is the limited space available for installation of the carburetor and fuel feed apparatus. The carburetor shown in U.S. Pat. No. 3,275,306 has been commercially produced and used extensively with chain saw engines. The size of the carburetors made according to the disclosure of this patent is about $1\frac{1}{2}\times1\frac{5}{8}\times1\frac{3}{4}$ inches which, at the time of that invention, was considered very compact. The combined fuel pump and carburetor weighed about 5 ounces.

Carburetors of the type disclosed in Van Camp et al., U.S. Pat. No. 3,746,320 are generally die cast of a low melting alloy or metal such as zinc. Further, carburetors are now being made of plastic or resin based materials. Such carburetors are exposed to elevated temperatures from the internal combustion engines on which they are mounted. The mounting bolts are frequently secured with a torsional load of 30 to 50 inch-pounds. Such mechanical loads and thermal exposure lead to a condition referred to as 'creep', that is, a continuous deformation of materials under steady load.

The observable effect of such creep is a noticeable deformation of the body of a craburetor. This physical deformation disturbs fluid flow and fuel metering in a carburetor, as the fluid flow channels and valve seats are distorted.

SUMMARY OF THE INVENTION

The present invention embraces a combined carburetor and fuel pump construction which is very small and compact, and yet provides a configuration of mixing passage facilitating a high volume flow of air and fuel mixture adequate to operate chain saw engines or engines of a similar character efficiently at all speeds. The present invention further provides external supports of a more creep-resistant material to maintain the shape of such carburetors. A flexible, suspended needle valve seat for fuel flow is provided to absorb internal deformation in the fuel passage and thus obviate a fuel flow problem in the needle valve fuel passage. This construction allows carburetor body distortion or deformation up to 0.010 inch without needle valve seat deformation, whereas normally a body distortion of only 0.002 inch will distort a needle valve seat and thus inhibit accurate fuel metering. The external supports provide a heat sink-heat transfer means to further inhibit high temperature thermal effects on the carburetor. The deleterious thermal effects of engine heat on a small carburetor are especially noticeable on a plastic carburetor, which generally has a lower resistance to elevated temperatures than does a metal structure. However, both resin-based and metallic carburetor bodies are known to suffer deformation.

Further advantages of this invention will be apparent from a consideration of the specification and accompanying drawings.

DRAWINGS

In the figures of the drawing, like reference numerals identify like components and in that drawing:

FIG. 5 is an elevational view of the opposite side of the carburetor and fuel pump apparatus;

FIG. 6 is a view of the opposite or mixture outlet end of the carburetor;

FIG. 7 is an enlarged longitudinal sectional view through the carburetor on the longitudinal axis of the mixing passage;

FIG. 8 is an enlarged transverse sectional view, the section being taken substantially on the line 8—8 of FIG. 2;

FIG. 9 is a sectional view taken substantially on the line 9—9 of FIG. 8;

DETAILED DESCRIPTION OF THE INVENTION

The diaphragm carburetor and pump construction embodying the invention is particularly usable with but not limited to low horsepower, two cycle engines, especially engines employed for powering chain saws, lawnmowers, portable drills and wherever a compact, lightweight carburetor and pump construction is desired.

The carburetor and fuel pump construction has particular utility for use with chain saws where it is imperative to reduce weight. The carburetor is operable in all angular positions, including an inverted position, a necessary requisite for chain saw operation. FIGS. 2 through 6 are full scale illustrations of a carburetor and fuel pump combination employed with two-cycle chain saw engines.

Figure 1:
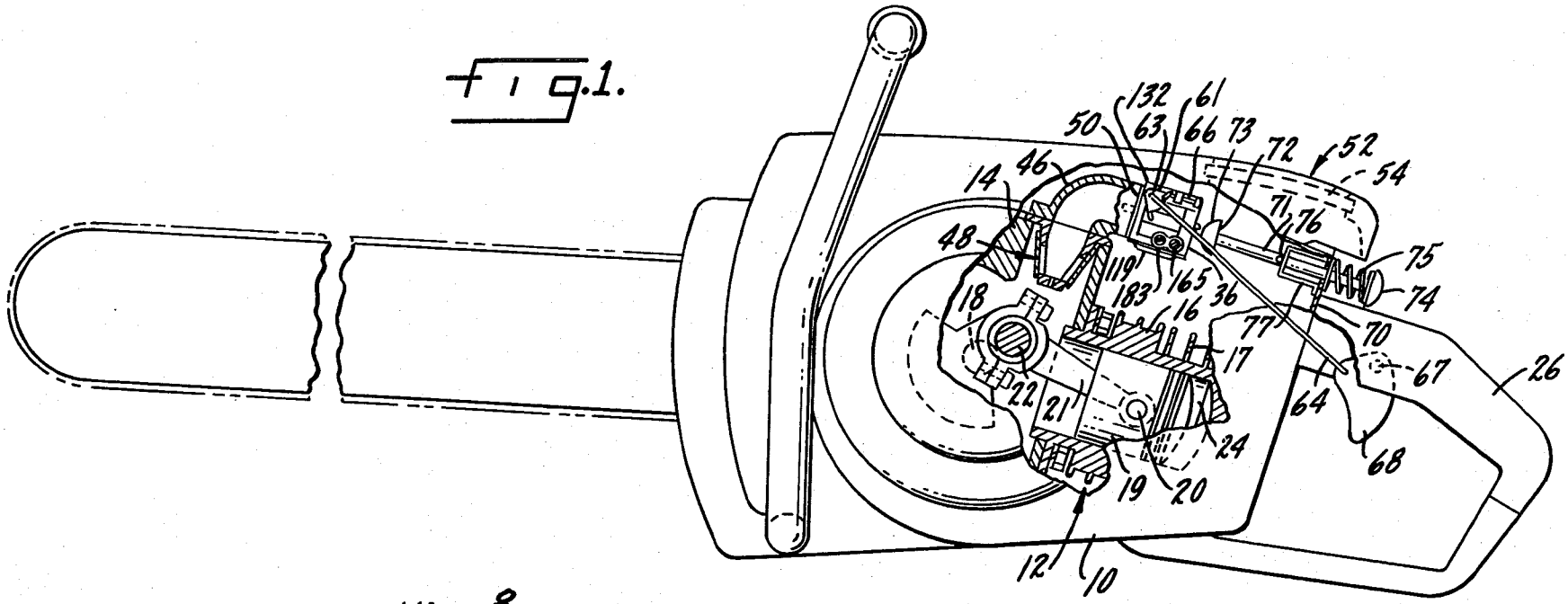
FIG. 1 is a side view, partly in section, of a chain saw construction powered by a two-cycle engine illustrating one form of the charge forming and fuel feed apparatus of the invention associated therewith.
Figure 2:
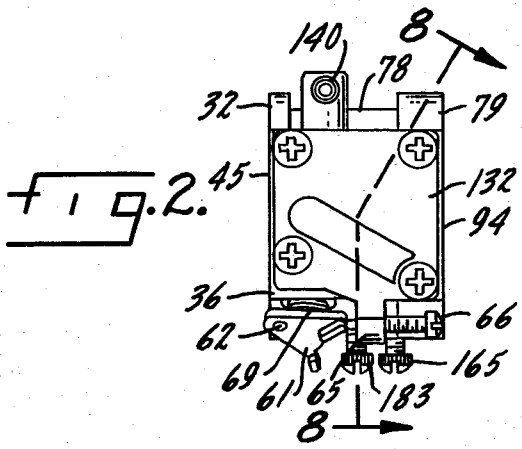
FIG. 2 is a top view of the combined carburetor and fuel pump apparatus embodying the invention.

Referring to the drawings in detail and initially to FIG. 1, there is illustrated an internal combustion engine driven chain saw of convential construction embodying a form of charge forming and fuel feed apparatus of the invention. The saw includes a housing 10 enclosing frame means (not shown) and an engine 12 of the reciprocating piston two-cycle type. Engine 12 includes a crankcase 14 and a cylinder 16, the walls of the cylinder being fashioned with cooling fins 17.

The engine embodies a conventional crankshaft 18 journaled in crankcase 14 and a piston 19 reciprocable in cylinder 16, the piston having a piston pin 20 connected by a connecting rod 21 with a crankpin 22 of crankshaft 18. The head of the cylinder is bored to receive a spark plug (not shown) for igniting the fuel and air mixture in a combustion chamber or region 24 above the piston 19.

The engine is provided with a port or passage (not shown) for conveying fuel and air mixture from crankcase 14 into combustion chamber 24 in a manner conventional in two cycle engines. The cylinder is provided with an exhaust port (not shown) of conventional type through which exhaust gases are removed from the cylinder after each power stroke of the piston. The construction and operation of the chain saw are conventional, as known in the prior art.

The fuel feed system and charge forming apparatus includes the diaphragm carburetor and diaphragm fuel pump construction shown in FIGS. 2 through 9. The carburetor portion includes a carburetor body 36, which is preferably of injection moldable resin such as Minlon 11 C40, Valox or Ryton. The carburetor body is shown full scale in FIGS. 2 through 6. The body is of generally cubical shape and is fashioned with an air and fuel mixing passage 38, shown in FIG. 7, the passage having an air inlet region 40 and a mixture outlet region 42.

The mixing passage 38 includes a modified venturi-shaped configuration which will be hereinafter described in detail, the air inlet region being defined by a curved configuration 43 and a flat or first planar surface 94. The mixture outlet end of the carburetor has a uniplanar or second mounting surface 45 which, as shown in FIGS. 1 and 5, is adapted for attachment to an intake manifold 46 for conveying fuel and air mixture into the engine crankcase 14. As shown in FIG. 1, a conventional reed valve construction 48, for example, controls delivery of mixture into the crankcase. A gasket 50 is disposed between the carburetor body and the intake manifold 46.

The housing 10 includes a cover portion 52 having an air inlet passage in which is disposed an air filter 54 to filter air admitted to air inlet 40 of the carburetor. Journaled in bores in the wall defining the mixture outlet region 42 of the mixing passage is a throttle shaft 56. The region of the throttle shaft within mixture outlet 42 has a slot 57 in which is mounted a disc-type throttle valve 58 with detents 59. The throttle shaft 56 is provided with scallops 60 to receive detents 59 securing the throttle valve 58 to the shaft 56.

A portion of the throttle shaft outside of the carburetor body is equipped with a plate 61 having at least one opening 62 for accommodating an end 63 of a throttle operating rod 64, shown in FIG. 1. A threaded boss 65 on a pump cover plate 132 supports a screw 66 engageable with the plate 61 for adjusting the engine idling position of the throttle valve 58. Pivotally mounted on the hand grip portion 26 is a pin 67 which pivotally supports a throttle valve actuating member or trigger 68 connected with rod 64, so the operator can manipulate the throttle valve through pivotal movement of member 68. A spring 69 surrounding throttle shaft 56 normally biases member 61 in a direction to maintain the throttle valve 58 in near-closed, or engine idling position.

The curved surface 43 defining air inlet 40 of the mixing passage is in the shape of a partial section of a torus, which configuration facilitates smooth flow of air into the mixing passage. Curved surface 43 is also referred to as a curved surface of revolution. Means is provided independent of the carburetor for temporarily obstructing the air inlet 40 for engine starting purposes. As shown in FIG. 1, a wall 70 of the chain saw housing 10 is fashioned with an opening slidably accommodating a rod 71 having a partially spherically shaped or dome-like closure member 72 mounted on the end of the rod adjacent the air inlet region 40.

The spherically shaped surface 73 of member 72 is adapted, when engaged with the surface 43 of the air inlet region, to close or obstruct the air inlet region as a choke means for engine starting purposes. Rod 71 extends through the opening in housing wall 70 and through an opening in a guide member or bracket 77, and has a button or enlarged portion 74 provided on the end thereof. Disposed between button member 74 and wall 70 is an expansive coil spring 75, which normally biases the rod in a direction to move air inlet closure member 72 away from the inlet region and maintains the air inlet region normally open. A pin 76 extends through a transverse opening in the rod 71 and forms an abutment engaging the bracket 77 to limit the extent of movement of the closure member 72 in a direction away from the air inlet region of the carburetor. The member 72 may be a flat plate and, if desired, may be slidable transversely for opening and closing the air inlet region in a well known conventional manner.

The mounting means for securing the carburetor to the mixture manifold 46 minimizes the transmission or conduction of heat from the engine crankcase wall to the carburetor body. Fashioned on the exterior of carburetor body 36, at the end of the carburetor adjacent air inlet region 40, are laterally projecting boss portions 79 which are provided with bores 80. Fashioned at the end of the carburetor adjacent mixture outlet region 42 are a second set of laterally projecting boss portions 32 coplanar with surface 45 and including bores 34. Each bore 34 is in spatial alignment with a bore 80 of the boss portion 79. Cylindrically shaped support members 78 with bores 83 are secured between each set of bores 34 and 80, and are flush with the uniplanar mounting end 45 and the air inlet region surface 94. The support member 78 are generally of a rigid material such as brass, aluminum or steel and capable of withstanding normal mounting bolt torque loads of 30–50 inch-pounds without deformation. Manifold 46 is provided with threaded bores 81 to receive the threaded portions of the securing or mounting bolts 82 and 82*a*. Mounting bolts 82 and 82*a* extend through bores 83 of cylindrical support members 78. It has been found that carburetor bodies of plastic materials noted above start to deform at mounting bolt loads as low as 5 inch-pounds, whereas normal specification bolt loads are 30–50 inch-pounds.

Figure 3:
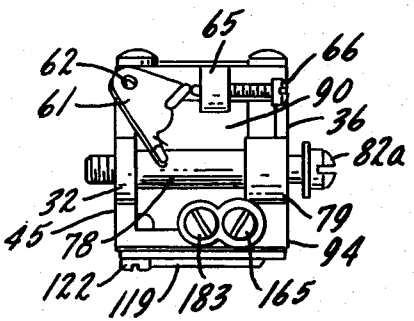
FIG. 3 is a view of one side of the apparatus shown in FIG. 2.
Figure 4:
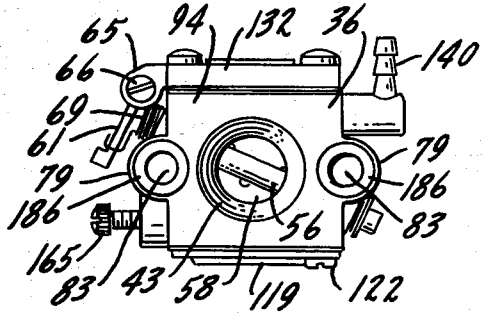
FIG. 4 is a view of the air inlet end of the apparatus.
Figure 10:
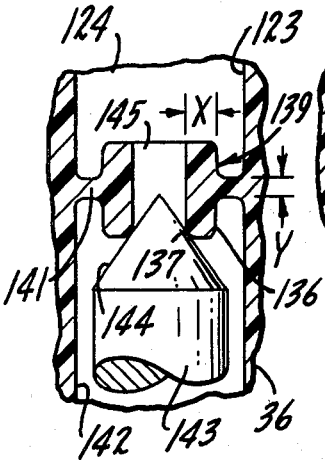
FIG. 10 is an enlarged view of a preferred embodiment of the needle valve seat.
Figure 14:
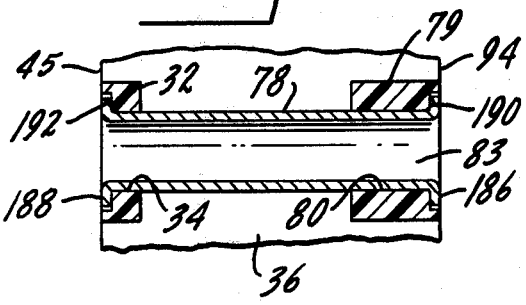
FIG. 14 is an enlarged view of a preferred embodiment of the support member and boss configuration of the carburetor.
Figure 15:
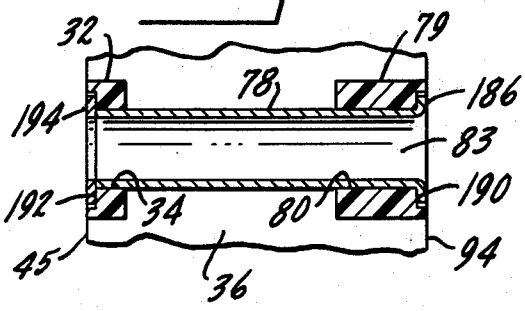
FIGS. 15, 16 and 17 are enlarged views of alternative embodiments of the support members are boss configuration.
Figure 16:
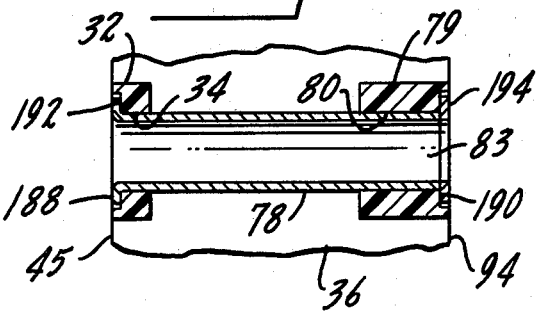
Figure 17:
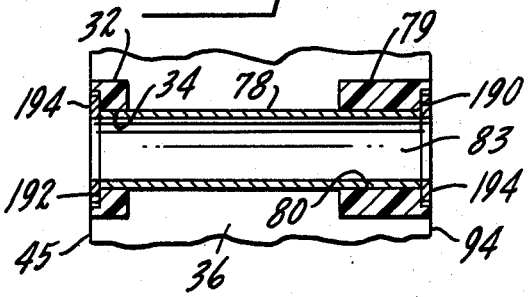

Cylindrically shaped support members 78 as shown in FIGS. 3, 5 and 9 are provided with flared ends 186, 188 as better seen in the enlarged view of FIG. 14. Lateral boss portion 79 and second lateral boss portion 32 define counterbores 190 and 192, respectively, to receive and retain flared ends 186, 188 flush with planar surfaces 94 and 45. Support members 78 are thereby secured between the aligned sets of boss portions 79, 32. Alternative embodiments of support members 78 positioned in boss portions 79, 32 are illustrated in FIGS. 15, 16 and 17. In FIGS. 15 and 16 support member 78 is flared at one end only, and positioned against a washer or annular member 194 inserted into counterbore 192 or 190. Washer 194 is secured in the counterbore by staking, pressing or other means known in the art and is coplanar with planar surfaces 45 and 94, respectively. In a further embodiment, shown in FIG. 17, washers 194 are positioned in both counterbores 190 and 192 of lateral bosses 79 and 32, respectively. Cylindrical support member 78 is positioned through bores 80 and 34 of bosses 79 and 32, respectively, to be constrained between the washers 194 of counterbores 190, 192.

As shown in FIGS. 3 and 5, the boss portions 79 are of a length preferably slightly less than one-third of the length of the carburetor body, or about five-sixteenths of an inch. Boss portions 32 are of a length about one-half the length of boss portions 79. As shown in FIGS. 3 and 6, carburetor body 36 is fashioned with generally rectangular recesses 90 to effect reduction in weight of the carburetor body, to provide a gap for air flow and to further reduce transmission of engine heat to the body from the bolts 82 and **82*a* and support members 78. Support members 78** provide a large surface area for air flow and heat transfer to enhance the ambient air effect on the cooling of the bolts, thereby reducing heat transfer to the carburetor body from the engine.

A feature of the carburetor involves a shape or configuration for the mixing passage which, although generally resembling a venturi, involves a special or modified configuration which, among other advantages, provides for an increased fluid flow through a restricted region of the mixing passage of reduced diameter. This feature makes possible a substantial reduction in size and weight of the carburetor, while still attaining increased volumetric or air flow efficiency. These advantages are retained in spite of body size reduction and a change of construction material.

The actual size of the carburetor body as shown in FIGS. 2 through 6, is approximately 1⅛ inches in length, 1 1/16 inches in height (excluding the thickness of pump plate 132 and diaphragm cover 119), and, excluding protruding portions of bosses 79, about 1⅛ inches in width. The particular configuration or shape of the mixing passage is illustrated in FIG. 7. The curvature of surface 43 defining air inlet 40 is derived as a surface of revolution of a radius 93 about a circular line in a plane A—A normal to the longitudinal axis B—B of the mixing passage. The terminus of the curved surface 43 converges or blends into the flat or planar surface 94 at the air inlet end of the carburetor. This feature enables the smooth flow of air into the air inlet region 40, this being another factor increasing the air flow efficiency or capacity of the mixing passage. The diameter of the most restricted region or choke band 95 of the venturi-like shape is indicated by dimension 96 which, in the carburetor illustrated, is approximately three-eighths of an inch.

It is to be understood that while the diameter of restricted zone 95 in the mixing passage illustrated is about three-eighths of an inch, which is the size required to accommodate air flow or volume of air for a particular size engine, the restricted band 95 may be of slightly lesser or greater dimension to accommodate engines of different sizes within the limitations of the size of the carburetor. Hence, the diameter 96 of the restricted zone 95 may be within a range of five-sixteenths inch to seven-sixteenths inch without increasing the over-all dimensions of the carburetor body.

In the embodiment disclosed the choke band or restricted region 95 is about one-sixteenth inch in width but may be of slightly greater width, the band terminating at the traverse plane 97. In the embodiment illustrated, the downstream curvature 100 is generated as a surface of revolution of a radius 109 about a circle in the terminal plane 97 defining the length of the choke band 95 and is a partial section of a torus in shape. The downstream terminus of curvature 100 is joined with the cylindrical surface 110 of the mixture outlet region 42 by an angular or frustoconical surface 112, the angularity of taper of the surface 112 being about 45° with respect to the longitudinal axis B—B of the mixing passage. The small diameter of the curvature 100 at the plane 97 defining the length of the choke band is of slightly greater diameter than the diameter 96 of the choke band. This increase in diameter provides an annular recess or space adjacent the terminus 97 of the choke band 95 of a depth or thickness indicated at 104 of from five-thousandths of an inch to eight-thousandths of an inch, and preferably about six-thousandths of an inch.

Thus, the annular enlargement provided at the region or zone of intersection of the curvature 100 with the terminal plane 97 of the choke band 95 provides an annular region of reduced pressure, and the main orifice 106 provided by a passage 107 in the carburetor fuel channel system, opens into this annular region of reduced pressure. The delivery of fuel for normal and high speed engine operation through main orifice 106 into the annular or circular zone 102 of reduced pressure adjacent the terminal plane 97 of the choke band promotes a more homogeneous mixture of fuel and air. The annular region 102 of reduced pressure influences the fuel delivered from orifice 106 to migrate or move circularly in the annular zone 102 of reduced pressure, thereby minimizing the tendency for the fuel to be delivered into the central region or core of the air stream moving through the area defined by the choke band.

This tendency for the fuel to migrate or spread around the circular zone 102 of reduced pressure fosters improved mixing of the liquid fuel with the air flowing through the mixing passage so that a more homogeneous combustible mixture is attained. This factor increases the efficiency of the engine through improved homogeneity of the mixture, by delivering the fuel from the orifice 106 into an annular reduced pressure zone in the mixing passage.

An important factor providing increased efficiency of mixture flow through the mixing passage resides in the downstream curvature 100 of the passage wall. By fashioning the surface 100 as a surface of revolution about a circle in the plane 97, the fuel and air mixture tends to flow smoothly along and in contact with the curved surface 100 without turbulence as the mixture expands after moving through the restricted zone 95. In a conventional venturi shape, the surface downstream of the restricted zone or choke band is of frustoconical shape providing a progressive increase in cross section of linear character. The curved surface of revolution 100 provides a nonlinear or accelerated increase in cross sectional area at succeeding equal increments of distance axially of the mixing passage downstream of the ledge 102. This facilitates progressively accelerated increase in expansion of the fuel and air mixture, providing improved flow efficiency and increased delivery of mixture into the engine.

In the carburetor arrangement of this invention, it is imperative that the main fuel delivery orifice 106 open into the mixing passage at a region downstream of the terminal plane 97 of the choke band 95, and as close as practicable to plane 97, in order to obtain the advantage of the reduced pressure zone tending to spread the fuel in the air stream moving through the choke band 95.

The carburetor of the invention embodies a main or primary fuel delivery system for normal and high speed engine operation and an engine idling and low speed secondary fuel delivery system which are similar to the systems disclosed in Phillips' U.S. Pat. No. 3,275,306. The carburetor body is fashioned with a circular recess or fuel chamber 115, shown in FIGS., 7, 8 and 9 herein and a flexible member or diaphragm 117 extends across the recess forming one wall of fuel chamber 115. A gasket 118 is disposed between the periphery of the diaphragm and the planar surface of a portion of the carburetor body defining the fuel chamber 115. A cover member 119 is disposed beneath the diaphragm and has a central depressed region to facilitate flexing of the diaphragm, the cover 119 being provided with a vent opening 120. Screws 122 extend through registering openings in the cover 119, diaphragm 117 and gasket 118 and are threaded into openings in the body 36 to secure these parts in the positions shown in FIGS. 7 and 8. Diaphragm 117 is adapted to be flexed or actuated by reduced pressure or engine aspiration in the mixing passage 38 for controlling delivery of liquid fuel into the unvented fuel chamber 115.

Body 36 is fashioned with a fuel inlet passage 124 with wall 123 in which is disposed a fuel filter or screen 125. The duct or passage 124 is in communication with a fuel delivery channel 127 of a fuel pump construction 128 as shown in Phillips' U.S. Pat. No. 3,275,306. The pump includes a pumping diaphragm 130, a cover member or plate 132, a fuel chamber 133 formed in the body 36 at one side of the diaphragm and a pulse or pumping chamber 135 formed in the cover plate 132. The pulse chamber 135 is connected with a pulse channel 138 which opens at the mounting face 45 and registers with an opening in the crankcase wall, whereby varying fluid pressure in the engine crankcase flexes or vibrates the pumping diaphragm 130 to pump fuel from a supply to the carburetor. A nipple 140, extending into an opening in the carburetor body, is connected by a tube (not shown) with a fuel tank. The pumping diaphragm 130 is fashioned with flap valves (not shown) cooperating with ports in communication with the fuel chamber 133 whereby fuel is pumped under comparatively low pressure to the inlet passage 124 in the carburetor.

As shown in FIG. 8, a bore 142 in the carburetor body accommodates a valve body or member 143 slidably disposed therein. The valve body 143 is of polygonal cross section and is fashioned with a needle valve portion 144 cooperating with a port 145 opening into the inlet duct 124.

Figure 11:
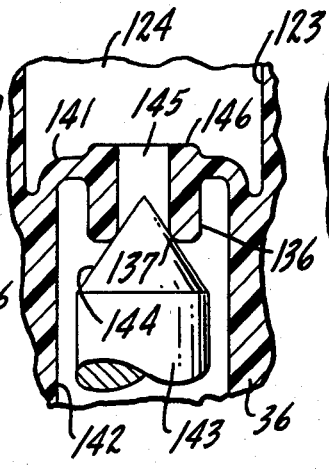
FIGS. 11, 12 and 13 are enlarged views of alternative embodiments of the needle valve seat.
Figure 12:
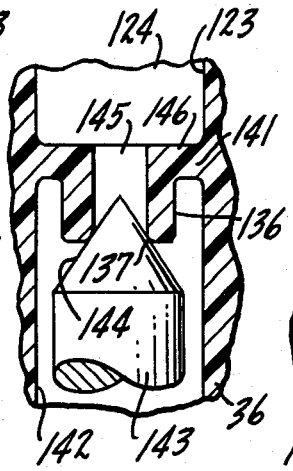
Figure 13:
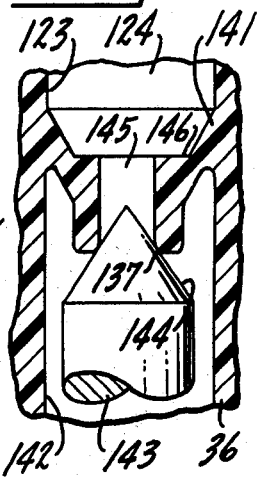

Port 145 is defined by cylindrical body 139 with a wall thickness 'x' as shown in FIGS. 10 to 13, which port communicates between bore 142 and inlet duct 124. Cylindrical body 139 is suspended in bore 142 by a web 141 with a wall thickness 'y' that is thinner than the wall thickness 'x' of cylinder 139. Needle valve seat 137 is defined by cylinder 139 to receive needle valve portion 144 to seal communication through port 145. Web portion 141 provides a means to deform or flex in conjunction with carburetor body deformation from creep or other causes without deforming needle valve seat 137 to thus preserve controlled fuel flow to fuel chamber 115. As shown in FIGS. 11, 12 and 13 cylindrical body 139 defines a first or valve seat end 136 and a second cylindrical body end 146 at which second end 146 web portion 141 is affixed.

Fulcrumed on a pin 147 and disposed in the fuel chamber 115 is a lever 149, the long arm of the lever engaging a button-like member 150 secured to the central region of the diaphragm and extending through reinforcing discs 151 and 153. The short arm of the lever is engaged with the lower end of the valve body 143. An expansive coil spring 155 engages the long arm of the lever adjacent the fulcrum, the spring normally biasing the valve 144 to a position closing the port 145. Through this arrangement the valve body 143 is responsive to the flexing movements of the diaphragm 117.

The main or primary fuel delivery system includes main orifice 106, being the outlet of passage 107, the latter being in communication with a well 157. Disposed between the passage 107 and the well 157 is a foraminous member 158, such as a fine mesh screen, positioned to be wet by the fuel being delivered. When thus wet, the liquid fuel adhering to the screen by capillary action forms a liquid or capillary seal to prevent back bleeding of air through the main orifice into the secondary fuel into the mixing passage. The principle of a capillary or liquid fuel seal for the prevention of back bleeding through the main orifice is described in the Phillips' U.S. Pat. No. 2,841,372. The capillary or liquid seal is readily broken or overcome upon an increase in engine speed by reason of the increase in aspiration or reduced pressure in the mixing passage with the throttle open, thus reestablishing fuel delivery through the main orifice 106 for intermediate and high speed engine operation.

The body 36 is fashioned with a bore 160 having a threaded portion to receive a threaded body of an adjusting valve member 162, the member 162 having a needle valve portion 163 which extends into a restricted passage 164 opening into the well or recess 157.

The valve body 162 is provided with a knurled manipulating head 165. The bore 160 is in communication with the fuel chamber 115 by a passage 167, shown in broken lines in FIG. 9. Fuel for normal and high speed engine operation flows from the diaphragm fuel chamber 115 through passage 167, bore 160, past the needle valve 163, through restriction 164 and well 157 for discharge through the main orifice 106 provided by the passage 107.

The secondary fuel delivery system for engine idling and low speed operation includes a supplemental chamber 170 which is in communication with the mixing passage 38 by way of an engine idling orifice 171 and a low speed orifice 172. The body 36 is fashioned with a bore 174 having a threaded portion to accommodate a threaded portion of a valve body 175. The valve body 175 has a tenon provided with a needle valve portion 177 extending into and cooperating with a restricted passage 178 which opens into a recess 179 of the fuel chamber 115.

The supplemental chamber 170 is connected with the bore 174 by a passage 181 shown in FIG. 9. The valve body 175 is fashioned with a knurled manipulating head 183.

The operation of the carburetor is as follows. Assume that the carburetor has been previously operated and the fuel chamber 115 is filled with liquid fuel which had been pumped from the supply tank by the diaphragm pump 128 to the region of the inlet valve 144. The pumping diaphragm is actuated by varying fluid pressure from the engine crankcase when the engine is cranked or started. In starting the engine, the operator exerts pressure on button 74 on rod 71 and thereby moves the partial spherically shaped member 72 into engagement with the curved surface 43 to substantially close air inlet 40 of mixing passage 38.

The engine is then cranked by the operator with throttle valve 58 in partial or full open position. With air inlet 40 substantially closed by the member 72, engine aspiration in the mixing passage is effective to aspirate fuel from fuel chamber 115 past needle valve 163 through well 157 and passage 107, the fuel being discharged through main orifice 106, thus starting the engine. As soon as the engine is operating, the operator removes manual pressure from button 74, and spring 75 retracts member 72 away from surface 43, thereby opening inlet 40.

In normal or high speed operation of the engine, the fuel aspirated into the mixing passage through main orifice 106 enters the mixing passage at the annular region of reduced pressure provided at region 102 adjacent choke band 95 of the venturi-like configuration. Through this method of delivering the fuel into an annular region of reduced pressure in the mixing passage, the fuel is more uniformly mixed with the air moving through the mixing passage to provide a homogeneous mixture of fuel and air. The aspiration in the mixing passage is influential through main orifice passage 107, fuel well 157 and fuel channels 164, 160 and 167 to establish reduced pressure in fuel chamber 115.

Reduced pressure established in fuel chamber 115 flexes the diaphragm upwardly, as viewed in FIG. 8, swinging lever 149 about fulcrum 147 in a counterclockwise direction whereby inlet valve 144 moves downwardly and opens inlet port 145 to effect flow of fuel into chamber 115 at the rate at which the fuel is aspirated into the mixing passage from fuel chamber 115 through main orifice 106. The rate of fuel delivery through the main orifice is regulated or controlled by manually operated needle valve 163.

When the throttle valve 58 is in engine idling position, that is, in the position shown in FIG. 7, fuel for engine idling operation flows from fuel chamber 115 through restricted passage 178, past needle valve 177, through bore 174, passage 177 into the supplemental chamber 170 and is delivered through engine idling orifice 171 at the downstream side of throttle valve 58. During idling operation of the engine the liquid fuel adhering to member or screen 158 prevents the back bleeding of air from the mixing passage through main orifice 106 and into the engine idling fuel system so as not to impair the delivery of fuel for engine idling purposes.

When throttle valve 58 is partially opened, fuel flows from supplemental chamber 170 through both engine idling orifice 171 and low speed orifice 172. The fuel for delivery through secondary orifices 171 and 172 is regulated or controlled by adjustment of needle valve 177.

The special configuration of mixing passage illustrated in FIG. 7 and hereinbefore described provides for increased flow of air and fuel to the engine whereby a smaller size mixing passage may be used than has heretofore been possible in carburetors of this general character. It should be noted that the curvature 43 of the air inlet blends into the planar face 94 of the carburetor facilitating smooth flow of air through air inlet 40. The provision of annular zone 102 of reduced pressure adjacent choke band 95 or zone of maximum restriction effects distribution of the fuel delivered through main orifice 106 in an annular region, so that the fuel is more thoroughly mixed with the air moving through the mixing passage to provide a homogeneous mixture, thereby improving engine efficiency.

Another factor providing for high air flow movement through the mixing passage is that the mixing passage is of comparatively short length between entrance face 94 and mounting face 45. With this arrangement there is less frictional drag upon the air with a consequent increase in the air flow capacity of the mixing passage, this being another factor enabling the use of a mixing passage of reduced cross sectional dimensions capable of supplying adequate volume of mixture for all engine speeds.

The use of bosses 79 and 32 in cooperation with support members 78 in proximity to recessed areas 90 defined by carburetor body 36 provides the following distinct advantages: (1) more area for air flow past the bolts and carburetor to promote cooling of the carburetor and thereby inhibit thermal creep and deformation as well as minimizing the tendency for volatilizing the liquid fuel in the fuel chamber; (2) rigid support members allow for maximum torque to be applied to the mounting bolts without mechanically deforming a softer material such as a plastic; and (3) the use of such support members allows the use of lighter weight materials without a sacrifice in performance, carburetor body longevity or mechanical strength where it is required. The plastic used can be injection molded and can be of any suitable material such as Minlon 11 C40, Valox or Ryton. Similarly, die cast metals such as zinc or aluminum can be used for this application. Although these metals may be slightly heavier, more rigid and less susceptible to creep than plastic this phenomena is still known to be a persistent problem with such metals.

The needle valve seat 137 suspended by a web 141 in the fuel passage 142 can absorb a deflection or deformation of up to 0.010 inch without negatively affecting the fuel metered past needle valve 143. Present needle valve construction in cube type carburetors cannot accept body deflections greater than 0.002 inch without adversely affecting fuel flow and fuel metering. The carburetor, as shown in FIGS. 2 through 6, according to the dimensions given herein weighs about 3 ounces.

The carburetor of the invention is very small and much lighter than other diaphragm carburetors of comparable flow capacity. The method of mounting the carburetor reduces heat transfer to the carburetor body. The comparatively short mixing passage of the configuration hereinbefore described substantially reduces air friction or air drag with the consequent increase in flow capacity.

It is apparent that, within the scope of the invention, modifications of the described embodiments and different arrangements may be made. The present disclosure is illustrative merely, the invention comprehending all variations thereof.

We claim:

1. A carburetor for an internal combustion engine including, in combination, a substantially cubically shaped body provided with a mixing passage having an air inlet region extending from a first planar surface and a mixture outlet region terminating at a second planar surface which serves for mounting the carburetor on the engine, a fuel chamber in the body, a flexible diaphragm forming a wall of the chamber, a fuel inlet passage in the body, a valve for the fuel inlet passage, control means for said fuel inlet valve including a lever actuated by movement of said diaphragm under the influence of reduced pressure in the mixing passage, a main orifice opening into the mixing passage, a throttle valve in the mixture outlet region of the mixing passage, an engine idling orifice opening into the mixing passage at the downstream side of the throttle valve, fuel channel means in said body for conveying liquid fuel from the fuel chamber to the orifices, a first pair of bosses, one extending transversely from each side of the body adjacent the air inlet region, a second pair of bosses, one boss of said second pair extending transversely from each side of the body adjacent the mixture outlet region, each boss of the second pair being in parallel alignment with a boss of the first pair, each of the bosses having a bore, the bores of the aligned pair of bosses being in spatial alignment, a pair of hollow cylindrical metal support members, one extending between each pair of spatially aligned boss bores and secured therebetween such that the ends of said support members extend only to the first and second planar surfaces, wherein said hollow cylindrical metal support members can receive a mounting bolt through its hollow center portion, thereby providing both a heat sink for cooling said carburetor and a load bearing member substantially impervious to thermal and mechanical creep, and to mechanical compression from bolt torque.

2. A carburetor as claimed in claim 1, wherein said carburetor body is a plastic material.

3. A carburetor as claimed in claim 1, wherein said carburetor body is a die-cast metal.

4. A carburetor as claimed in claim 3, wherein said metal is zinc.

5. A carburetor as claimed in claim 3, wherein said metal is aluminum.

6. A carburetor as claimed in claim 1, wherein a pair of mounting bolts are provided for insertion in said hollow cylindrical metal support members, each mounting bolt having a given torque load, and each of said hollow cylindrical metal support members has a thermal and mechanical creep resistance above said given torque load.

7. A carburetor as claimed in claim 6, wherein said hollow cylindrical metal support member can withstand a torque load of at least 30 inch-pounds with no deformation.

8. A carburetor as claimed in claim 1, wherein said hollow cylindrical metal support members are brass.

9. A carburetor as claimed in claim 1, wherein said hollow cylindrical metal support members are steel.

10. A carburetor as claimed in claim 1, wherein said hollow cylindrical metal support members are aluminum.

11. A carburetor as claimed in claim 1, wherein said aligned bosses define counterbores at first and second planar surfaces coaxial with said boss bores, and wherein said cylindrical support members define a flare segment at each end thereof positioned in said couterbores to retain and secure said support members.

12. A carburetor as claimed in claim 1, wherein said aligned bosses define counterbores at first and second planar surfaces coaxial with said boss bores, said cylindrical support members define a flare segment at either end thereof to be positioned in a counterbore, and an annular member positioned in the counterbore of one of said spatially aligned bosses, which annular member of said support member abuts, and is secured against, said cylindrical support member.

13. A carburetor as claimed in claim 1, wherein said aligned bosses define counterbores at first and second planar surfaces coaxial with said boss bores, which counterbores have an annular member retained therein, between which annular members said support member is secured.

14. A carburetor as claimed in claim 1, wherein said fuel inlet passage defined by said carburetor body includes a generally cylindrically shaped body defining a body wall and a valve seat suspended in said fuel inlet passage by a webbing member substantially thinner than the body wall, thus providing a flexible membrane-like member to deflect without deformation to said valve seat.

15. A carburetor as claimed in claim 14, which cylindrical body defines a valve seat end and a second end wherein said webbing member is located along said cylindrical body nearer said second cylinder end.

16. A carburetor for an internal combustion engine including, in combination, a substantially cubically shaped body defining a mixing passage having an air inlet region and a mixture outlet region, a fuel chamber in the body, a flexible diaphragm forming a wall of the chamber, said body defining a fuel inlet passage, a valve seat positioned in said fuel inlet passage having a wall, a valve for the fuel inlet, control means for said fuel inlet valve including a lever actuated by movement of said diaphragm under the influence of reduced pressure in the mixing passage, a main orifice opening into the mixing passage, a throttle valve in the mixture outlet region of the mixing passage, an engine idling orifice opening into the mixing passage at the downstream side of the throttle valve, fuel channel means in said body for conveying liquid fuel from the fuel chamber to the orifices, said body having a planar mounting surface for mounting on an engine, characterized in that said valve seat is defined by a substantially cylindrically shaped body and suspended in said fuel inlet passage and secured to said fuel inlet passage wall by a web whose thickness is less than the wall thickness of said cylindrically shaped valve seat body.

17. A carburetor for an internal combustion engine including, in combination a substantially cubically shaped body defining a mixture passage having an air inlet region extending from a first planar surface and a mixture outlet region terminating at a second planar surface which serves for mounting the carburetor on the engine, a first pair of bosses, one extending transversely from each side of the body at the end of the body adjacent the air inlet region, a second pair of bosses, one of said second pair extending tranversely from each side of the body at the end of the body adjacent the mixture outlet region, each boss of the second pair being in parallel alignment with a boss of said first pair, each of the bosses having a bore, the bores of the aligned pair of bosses being in spatial alignment, a pair of hollow cylindrical metal support members, one extending between each pair of spatially aligned boss bores and secured therebetween such that the ends of said support members extend only to the first and second planar surfaces, wherein said support members can each receive a mounting bolt through its hollow center, thereby providing both a heat sink for cooling said carburetor and a load bearing member substantially impervious to thermal and mechanical creep, and to mechanical compression from bolt torque.

18. A carburetor as claimed in claim 17, wherein a pair of mounting bolts are provided for insertion in said hollow cylindrical metal support members, each mounting bolt having a given torque load, and each of said hollow cylindrical metal support members has a thermal and mechanical creep resistance above said given torque load.

19. A carburetor as claimed in claim 17, in which said body defines a fuel inlet passage having a wall, and having a valve seat positioned in said fuel inlet passage, characterized in that said valve seat is defined by a substantially cylindrical shaped body and is suspended in said fuel inlet passage, being secured thereto by a web whose thickness is less than the wall thickness of said cylindrically shaped valve seat body.

* * * * *

UNITED STATES PATENT AND TRADEMARK OFFICE

CERTIFICATE OF CORRECTION

PATENT NO. : 4,414,163

DATED : November 8, 1983

INVENTOR(S) : Rodney E. Barr and Daniel L. Donovan

It is certified that error appears in the above—identified patent and that said Letters Patent is hereby corrected as shown below:

Column 12, line 56, cancel "mixture" and substitute -- mixing --.

Signed and Sealed this

*Seventeenth* Day of *January 1984*

[SEAL]

*Attest:*

GERALD J. MOSSINGHOFF

*Attesting Officer*

*Commissioner of Patents and Trademarks*